US005195846A

United States Patent [19]

Lemperiere

[11] Patent Number: 5,195,846

[45] Date of Patent: Mar. 23, 1993

[54] SPILLWAY FOR DISCHARGING EXTRAORDINARY FLOODS AT DAMS HAVING AT LEAST TWO FLOOD DISCHARGE STRUCTURES

[75] Inventor: Francois Lemperiere, Meudon, France

[73] Assignee: GTM Entrepose, Nanterre, France

[21] Appl. No.: 806,704

[22] Filed: Dec. 12, 1991

[30] Foreign Application Priority Data

Dec. 28, 1990 [FR] France ..... 90 16430

[51] Int. Cl.[5] ..... E02B 7/22; E02B 8/06

[52] U.S. Cl. ..... 405/108; 405/90; 405/94; 405/111; 405/114

[58] Field of Search ..... 405/80, 87, 90, 94, 405/107, 108, 110, 111, 114

[56] References Cited

U.S. PATENT DOCUMENTS

| | | | |
|---|---|---|---|
| 565,019 | 8/1896 | Newburg | 405/115 X |
| 972,059 | 10/1910 | Clarke | 405/114 |
| 2,118,535 | 5/1938 | Betts | 405/94 |
| 2,961,731 | 11/1960 | Buzzell et al. | 405/114 X |
| 3,342,033 | 9/1967 | Crouch et al. | 405/114 |
| 4,650,368 | 3/1987 | Bayer | 405/111 |
| 4,661,014 | 4/1987 | Aubert | 405/111 |
| 5,032,038 | 7/1991 | Lemperiere | 405/108 |

FOREIGN PATENT DOCUMENTS

| | | | |
|---|---|---|---|
| 2212313 | 11/1978 | Fed. Rep. of Germany | 405/91 |

*Primary Examiner*—David H. Corbin
*Attorney, Agent, or Firm*—Amster, Rothstein & Ebenstein

[57] ABSTRACT

For the purpose of providing a more economical alternative to conventional control gates for the quasi-permanent closure of all or part of the length of the overflow spillway of a dam except when discharging extraordinary floods, the invention consists of installing on the sill of the spillway a water level raising means comprising at least one heavy element, held by gravity on the sill, the water level raising means or its element being designed to overturn at a predetermined head corresponding to a headwater level not higher than the predetermined maximum water level in order to discharge extraordinary floods, smaller floods being discharged by a separate flood discharge structure.

17 Claims, 10 Drawing Sheets

SPILLWAY FOR DISCHARGING EXTRAORDINARY FLOODS AT DAMS HAVING AT LEAST TWO FLOOD DISCHARGE STRUCTURES

TECHNICAL FIELD

This invention concerns a spillway for discharging extraordinary floods for dams and similar works having two flood discharge structures, one of the two discharge structures consisting of an overspill sill whose crest is set at a first predetermined level, lower than a second predetermined level corresponding to a maximum reservoir level for which the dam is designed, the difference between the said first and second predetermined levels corresponding to the predetermined maximum discharge of an extraordinary flood, and a moveable water level raising means closing off the said sill.

BACKGROUND OF THE INVENTION

Current practice for the design and construction of dams is such that their surplus water discharge works are designed for large floods (e.g. 1000- or 10,000-year flood). Consequently, only a very small portion of the said discharge works' flood discharge capacity is used most of the time. Furthermore, discharge over the sill is sometimes controlled by gates in order, mainly, to increase the storage capacity of the reservoir or increase the flood detention capacity of the dam.

In such arrangements, the said gates must obviously span the whole width of the overspill sill although most of them can remain almost always closed between occurrences of extraordinary floods and only be opened every twenty or fifty years for example. Where the second discharge structure can discharge the more frequent floods (as where the dam is provided with gated or uncontrolled surface spillways, submerged sluices or bottom outlets, or an intake to a hydro electric powerstation or any other discharge works), all the said gates may clearly remain closed more or less permanently.

Whatever type of gate may be used, refusal of the gates to open is a major cause of dam failure. Therefore, gates are less reliable and safe than uncontrolled overspills, and they have the added disadvantage of being costly.

Various more economical means of closing off an overspill sill exist or have been proposed such as sandbags and flashboards or other similar arrangements which require human action prior to the arrival of each river flood, thereby involving a major risk of unsuccessful operation.

Some large embankment dams are provided with a fuse dyke or breaching section topped out at a lower level than the rest of the structure and operating by erosion of its constituent materials caused by the reservoir filling to its maximum level during an extraordinary flood. The purpose of the breaching section is to prevent uncontrolled catastrophic overtopping of the whole dam by an extraordinary flood, by concentrating the effects of the flood on a special section designed to be washed away by erosion, thus providing an extra discharge capacity. When the breaching section has been washed away, major reconstruction work is needed before the dam can resume normal operation. Furthermore, the disappearance of a breaching section may lead to an excessively fast rise in discharge in the lower river reach.

The applicant has already filed applications for U.S. patents for water level raising elements U.S. Pat. Nos. 5,032,038 and 5,061,118 granted on Jul. 16, 1991 and Oct. 29, 1991 respectively and both entitled "Overflow Spillway for Dams and Similar Structures"). These water level raising elements have the advantage of closing off the sill at low cost. However, in so far as they are designed to discharge small and moderate floods, their height must be less than the maximum reservoir level.

The problem which the invention seeks to solve is the provision of a means of near-permanent closure of all or part of the length of an overspill sill at a much lower cost than that of gates and over a greater height than heretofore while at the same time ensuring totally reliable and safe discharge of extraordinary floods automatically and without any major modifications to the structure. The invention is thus an economical substitute for those gates designed to open only on the advent of the more infrequent floods.

To the applicant's knowledge, there would seem to be no means currently in existence of satisfactorily fulfilling the goals stated hereinabove, of simple operation and moderate cost.

SUMMARY OF THE INVENTION

With the invention, the abovementioned problem is solved by the fact that the water level raising means comprises at least one heavy rigid element resting on the crest of the overspill sill and held in place thereon by gravity, the said element having a predetermined height at least equal to the difference between the first and second predetermined levels and being of such size and weight that the moment of the forces applied by the headwater on the element comes to equal the moment of the gravity forces tending to maintain the element in place on the overspill sill so that consequently the element is destabilized when the headwater reaches a third predetermined level at most equal to the second predetermined level.

Under these circumstances, it is clear that all or part of the length of the overspill sill can be closed off by water level raising elements. The element(s) can be built at moderate cost as compared with the cost of gates and if they are installed on the sill of an existing dam, such installation, with or without the addition of accompanying gates, can be done without the need for any major modifications to the overspill sill of the dam as will be described hereinbelow. It is also clear that so long as the headwater level during floods of moderate size does not reach the said third predetermined level, which in practice can be set equal to or slightly lower than the said second predetermined level, i.e. at maximum reservior level, surplus water can be discharged through the gates or other devices designed to control the more frequent flows without the water level raising means being expelled and without the sill ceasing to be closed off by the said means. On arrival of an extraordinary flood however, the headwater level rises to the third predetermined level, one or more of the water level raising elements is destabilized and carried away by the hydraulic forces alone, without any input of external energy or action, thus freeing the overspill sill and restoring its full discharge capacity.

Although theoretically not essential, an abutment of predetermined height is preferably provided on the overspill sill at the toe and on the downstream side of the water level raising element to prevent its sliding downstreamwards on the sill without preventing it from overturning over the abutment when the headwater reaches the said third predetermined level. The height of the abutment is of course given consideration as will be described below in determining the size and weight of the element(s).

A seal may be provided between the sill and the base portion of the element near the upstream edge of the said base portion. Nevertheless such a seal is not absolutely essential if leakage between the element and the sill is otherwise slight and the area of the sill on which the said element(s) sit is properly drained so that no appreciable uplift pressure can establish under the said element(s) if no seal is provided. As will be described below, means can be provided for automatically establishing an uplift pressure under the said element(s) when the headwater reaches the said third predetermined level in order to assist the destabilizing and overturning of the said element(s) when necessary for discharging an extraordinary flood.

The invention is applicable to the sills of existing dam spillways as well as those under construction. In the first case, the crest of the existing sill can be cut back lower than the said first predetermined level and the water level raising element(s) placed on the lowered sill to close it. Safety is improved as compared with the unlowered spillway sill since the free passage obtained after overturning of the element(s) is deeper when the sill has been lowered so that the spillway can discharge a larger flood than the original design flood.

In designing a new dam, the difference between the first and second predetermined levels can be increased (which increases safety or, for the same maximum discharge capacity, reduces the cost of structures such as spillway chutes) without loss of control over outflow into the downstream reach of the river by combining devices discharging the more frequent flows with one or more water level raising elements of the invention.

In both cases, the difference between the first and second predetermined levels is set to obtain the best compromise between increased safety, reduced construction cost and any increased cost for the gates on the overspill sill.

If more than one element is to be provided, an element or group of elements can be designed to overturn at a lower predetermined headwater level than another element or group of elements which themselves can be designed to overturn at a lower headwater level than a third element or group of elements, and so on. In this way, it is possible, if desired, to increase discharge capacity progressively to suit the size of ther river flood.

If one or more elements have been overturned and expelled by an extraordinary flood, they can be conveniently and cheaply replaced with new elements without the need for any major repairs after the flood has receded.

Other features, benefits and advantages will appear in the course of the ensuing description of various embodiments of the invention, given as an illustration only, with reference to the appended drawings in which:

DETAILED DESCRIPTION

Figure 1:
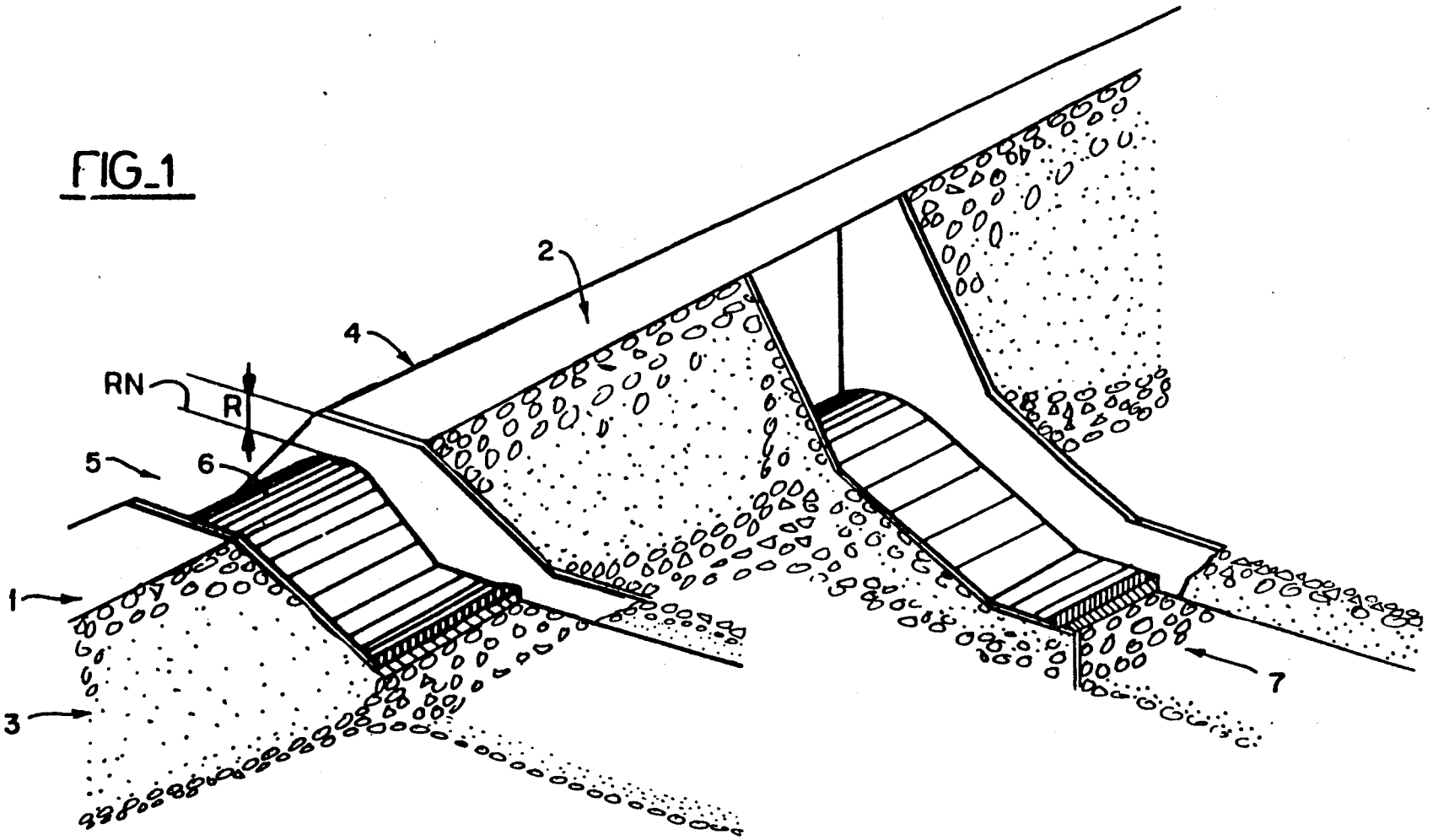
FIG. 1 is a perspective view of a structure to which the invention can be applied, such as a dam with its uncontrolled overspill sill for discharging extraordinary floods and a gated spillway for discharging more frequent floods.
Figure 2:
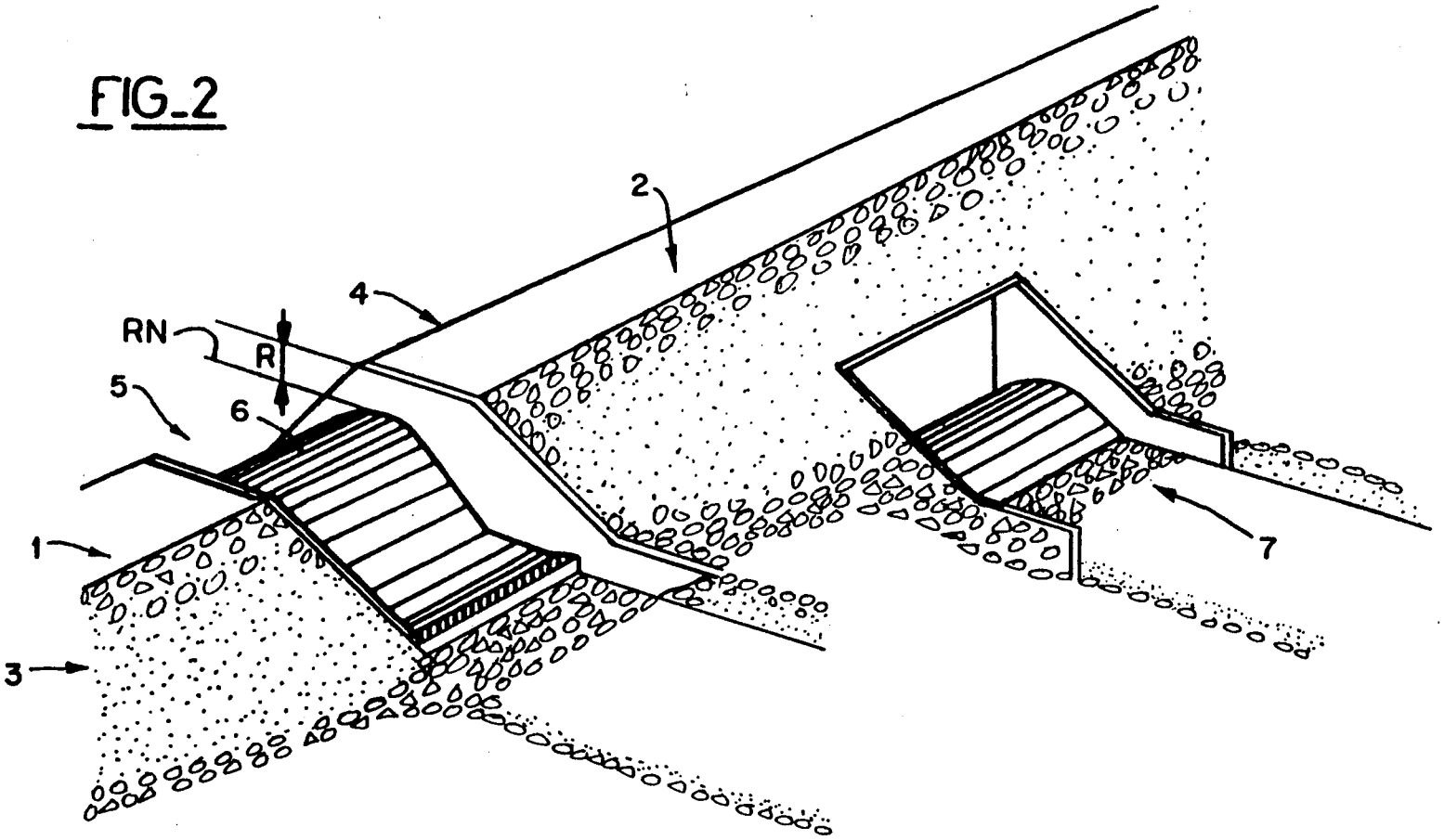
FIG. 2 is a perspective view of a structure to which the invention can be applied, such as a dam with its uncontrolled overspill sill for discharging extraordinary floods and another discharge structure such as a gated or ungated bottom outlet or hydroelectric power-station.

The structure 1 shown in FIG. 1 and FIG. 2 may be an earth or rock dam or a concrete or masonry dam. It is stressed that the invention is not confined to the type of dam shown in FIG. 1 or FIG. 2 but on the contrary is applicable to any type of know dam with an uncontrolled spillway.

In FIGS. 1 and 2, reference numeral 2 designates the dam crest, 3 is the downstream dam face, 4 is the upstream dam face, 5 is the spillway, 6 is the sill of spillway 5, 7 designates some form of flood discharge structure for discharging smaller, more frequent floods. Spillway 5 may be located in the central section of dam 1 or at one extremity thereof or excavated in the river bank without affecting the applicability of the invention. In FIG. 2, the flood discharge structure 7 is a conventional bottom outlet type. In FIG. 1, the flood discharge structure is an overspill type with conventional control gates. Nevertheless, the service spillway 7 could quite obviously be any known type of spillway without affecting the applicability of the invention.

At a dam of the type to which the invention is applicable, the headwater level between flood times is always lower than or equal to the level RN of the crest 8 of spillway 6 (level RN is called the full supply level for a dam having an uncontrolled overflow spillway). In times of flood, the headwater level is always lower than or equal to the highest flood level PHE or maximum water level RM.

The invention provides a near-permanent closure for the spillway 6. It consists of placing a fusible water level raising means 10 on the sill of spillway 6, consisting of at least one heavy rigid element 11, for example five elements 11*a*–11*e* as illustrated in FIGS. 3*a* and 3*b*, the said fusible water level raising means 10 or elements 11 being designed to overturn under a predetermined head corresponding to a level N not higher than the maximum level RM and thus allowing the largest floods to discharge.

Figure 3A:
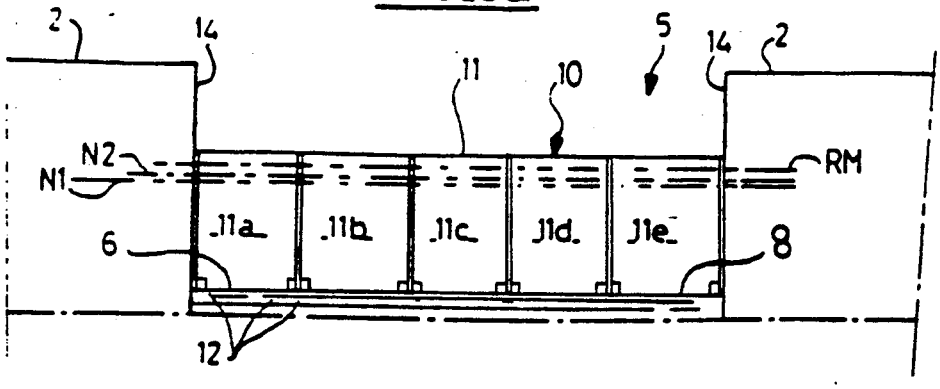
FIG. 3*a* is a view in elevation of the extraordinary flood spillway shown in FIG. 1 or 2 seen from the downstream side and provided with a fusible water level raising means of the invention.
Figure 3B:
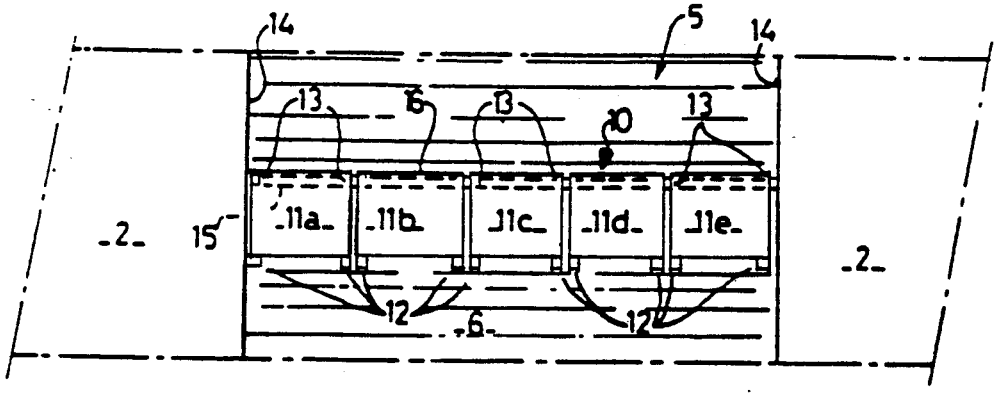
FIG. 3*b* is a plan view of the spillway shown in FIG. 3*a*.

The number of elements 11 in the water level raising means is not limited to five as shown in FIGS. 3*a* and 3*b* but may be more or less to suit the length (measured lengthwise along the dam) of the spillway 5. The number of elements is preferably chosen such as to have small unit weights for ease of installation and replacement of the said elements.

Each water level raising element 11, of height $H_1$ such that its top is higher than RM, is set on the spillway sill 6 and held in place by gravity. Each element is preferably restrained from sliding downstreamwards by an abutment 12 at the downstream toe of the element 11. The abutment 12 may for example be let into the sill 6 as shown by way of example in FIG. 4*a* and it may be discontinuous as illustrated in FIGS. 3*a* and 3*b*. Nevertheless, the abutment 12 may if desired be continuous. As will be described hereinunder, the height of the abutment 12 is predetermined but may be variable according to the loads involved and the headwater level at which it is desired that each element 11 commences to overturn.

As illustrated in FIG. 3*b*, a conventional seal 13 made of rubber for example is provided at each end of the water level raising means 10 between the said means and the training walls 14 of the spillway 5. When the water level raising means 10 is made up of more than one element 11, seals 13 are also provided between the vertical side faces of adjacent elements 11 as illustrated in FIG. 3*b*. Another seal 15 is also preferably provided between the spillway sill 6 and the undersides of water level raising elements 11 near the upstream edge 16 of the said undersides as illustrated by way of example in FIGS. 4*a* and 4*b*. As illustrated in FIG. 3*b*, seals 13 and seal 15 (when the latter is provided) are set in the same vertical plane. A drainage system in addition to or in place of the seal 15 can be incorporated in a known fashion in the spillway sill 6 where it underlies the water level raising means 10 in order to keep this area dry and prevent uplift pressures acting on the element(s) 11 under normal conditions.

Figure 3C:
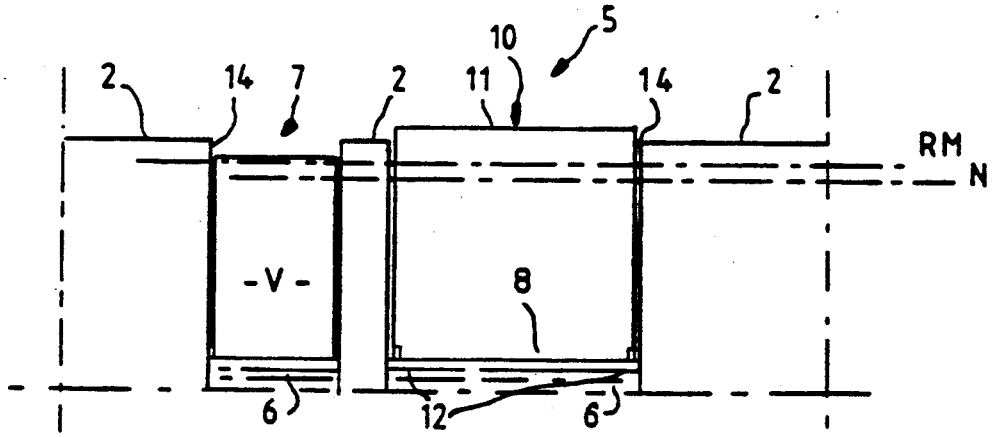
FIG. 3*c* is a view in elevation of another spillway provided with a fusible water level raising means of the invention.

As illustrated in FIG. 3*c* referring to a dam with only a single flood discharge structure in the form of an uncontrolled overspill, it is feasible to fit conventional control gates V to part only of the sill, the remainder being provided with a fusible water level raising means 10 of the invention. This would in effect result in a dam of the type covered by the invention with a single overspill combining two flood discharge structures, one (7) consisting of not less than one conventional gate V for discharging smaller, more frequent floods, and the other being a fusible water level raising means 10 for discharging larger floods.

Figure 4A:
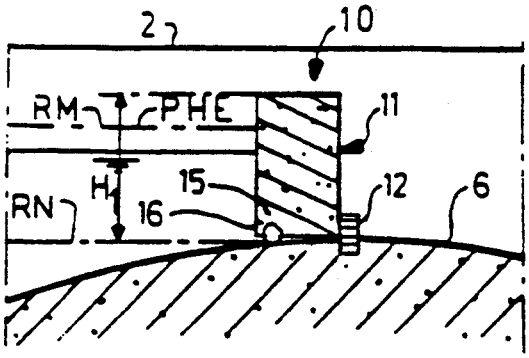
FIG. 4*a* and 4*b* are vertical sections illustrating the manner in which the fusible water level raising means of the invention functions.

As will be explained below, each water level raising element 11 is designed to be self-stable under water loads not in excess of the head applied by a predetermined water level N which is not higher than the maximum water level RM for which the dam is designed. If for example the said predetermined water level N is equal to RM then, so long as the water level remains below RM during floods of small to moderate size, the water level raising means prevents the spillway discharging as shown in FIG. 4*a* without the said means (10) overturning.

Figure 4B:
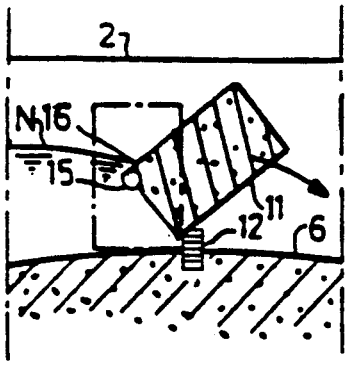

However if, under the circumstances described, the headwater level reaches the predetermined level N equal to or slightly lower than RM on arrival of a major or extraordinary flood or in the event of flood discharge structure 7 failing to operate, at least one of the elements 11 of the water level raising means 10 is destabilized by water pressure and rotates around the abutment 12 as shown in FIG. 4*b* and the element(s) 11 thus overturned are expelled and carried by the floodwater at least as far as the foot of spillway 5, thereby enabling the largest floods to discharge. After recession of a major flood which has overturned the water level raising means 10, the headwater level drops back to the full supply level RN or slightly lower. It is possible to carry a small number of spare elements 11 always available on site to make good the water level raising means 10 as necessary. It is however stressed that failure to replace any element(s) after a major flood or non-operation of the flood discharge structure 7 has caused one or more elements 11 to overturn in no way affects the operational safety of the dam or similar work.

There now follows a quantified example of the design of a fusible water level raising means of the invention. In normal practice, the dimensions of dams and overflow spillways are set such that the level of the headwater (reservoir level) reaches the maximum water level RM during the passage of a predetermined flood called the design flood. This may for example be the flood occurring only one year in a thousand years (1000-year flood).

Let it be assumed that the flow during the design flood is for example 900 $m^3/s$, that the maximum flow occurring on average over a fifty-year period is much lower than the design flood at 100 $m^3/s$, that the overspill crest 6 on which the water level raising means is set is 40 m long and that the flood discharge structure 7 has a discharge capacity of 100 $m^3/s$.

With these conditions, the depth of the overflowing nappe necessary for discharging the portion of the design flood not discharged by the flood discharge structure 7 represents 20 $m^3/s$ per linear meter of sill length. This depth can be calculated from the following equation:

$$Q=1.8H^{3/2}$$

from which it can be seen that the value of H is approximately 5 m under the stated conditions. Again, under these same conditions, the elevation of the sill 6 of spillway 5 must be set 5 m lower than the maximum water level RM in order to successfully discharge the 1000-year flood. The sill 6 can be provided with water level raising means of the invention, whose height is not less than 5 m.

The overturning of water level raising element(s) 11 and their ensuing expulsion is governed by the balance between two opposing forces, i.e. the driving moment, being the moment of the forces tending to overturn the relevant element and the resisting moment, being the moment of the forces tending to maintain the element stable. If no triggering device directly controlled by headwater level is provided to trigger the overturning of the element at precisely the predetermined water level, the water level at which the opposing forces are balanced can only be determined to within some degree of uncertainty which may be as much as 0.2 m. Under these circumstances, it may be necessary for safety reasons to reduce the level at which the element(s) is (are) designed to overturn by an amount commensurate with this margin of uncertainty, say by 0.2 m for example. Nevertheless it is possible to reduce this uncertainty by providing a triggering device which will be described below with reference to FIG. 7.

Figure 5:
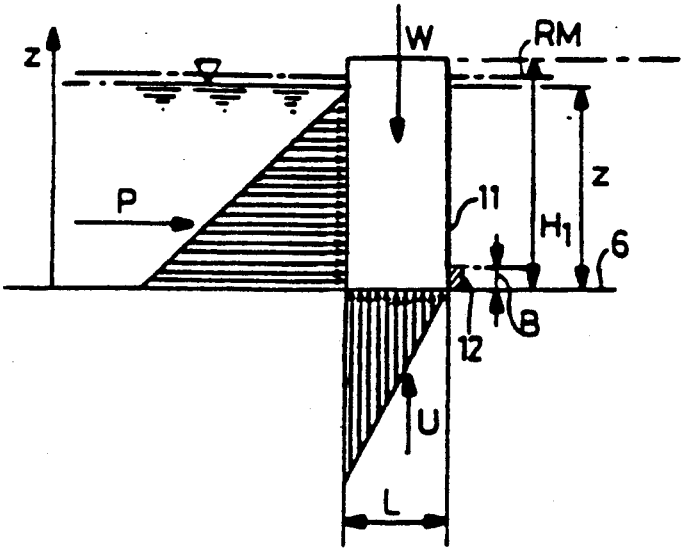
FIG. 5 is a graphical representation of the forces acting on a water level raising element of the invention in service.

FIG. 5 shows the forces which may be acting on a water level raising element 11 of the invention in service. In the description which follows, it is assumed that the element 11 is parallelepipedic in shape with a width (i.e. the dimension in the upstream-downstream direction) L and height $H_1$. In FIG. 5, B denotes the height of the abutment 12 above the sill 6 and z denotes the water level. The driving forces tending to overturn the element 11 are the pressure P of the water acting on the upstream face of element 11 and the uplift pressure U which under some conditions acts on the underside of the said element 11 if water leaks through the seals or if the triggering device to be described below functions. The resisting force tending to maintain the element 11 stable is the weight of the element W.

In calculating the values of P, U and W and the values of the corresponding driving and resisting moments with respect to abutment 12, it is necessary to consider two conditions arising from the depth of water z above the sill 6. The values of P, U and W and the corresponding driving and resisting moments are summarised hereunder, the values being expressed per unit length of element 11.

a) If $0 < z < 3B$:

$$P = \frac{1}{2} \cdot \gamma w \cdot z^2 \quad (2)$$

$$U = \frac{1}{2} \cdot \gamma w \cdot z \cdot L \quad (3)$$

$$W = \gamma b \cdot H_1 \cdot L \quad (4)$$

$$Mm = O \quad (5)$$

$$MmU = \frac{1}{3} \cdot \gamma w \cdot z \cdot L^2 \quad (6)$$

$$Mr = \frac{1}{2} \cdot \gamma b \cdot H_1 \cdot L^2 + \frac{1}{2} \cdot \gamma w \cdot z^2 \cdot \left(B - \frac{z}{3}\right) \quad (7)$$

b) If $3B < z < H_1$ $$P = \frac{1}{2} \cdot \gamma w \cdot z^2 \quad (8)$$

$$U = \frac{1}{2} \cdot \gamma w \cdot z \cdot L \quad (9)$$

$$w = \gamma b \cdot H_1 \cdot L \quad (10)$$

$$Mm = \frac{1}{2} \cdot \gamma w \cdot z^2 \cdot \left(\frac{z}{3} - B\right) \quad (11)$$

$$MmU = Mm + \frac{1}{3} \cdot \gamma w \cdot z \cdot L^2 \quad (12)$$

-continued $$Mr = \frac{1}{2} \cdot \gamma b \cdot H_1 \cdot L^2 \quad (13)$$

In the equations hereinabove shown, P, U, W, L, $H_1$, B and z designate the parameters as hereinabove defined. Mm is the driving moment in the absence of uplift pressure U, MmU is the driving moment in the presence of uplift pressure U, $\gamma w$ is the unit weight of water, $\gamma b$ is the mean unit weight of the water level raising element and Mr is the resisting moment.

Figure 6:
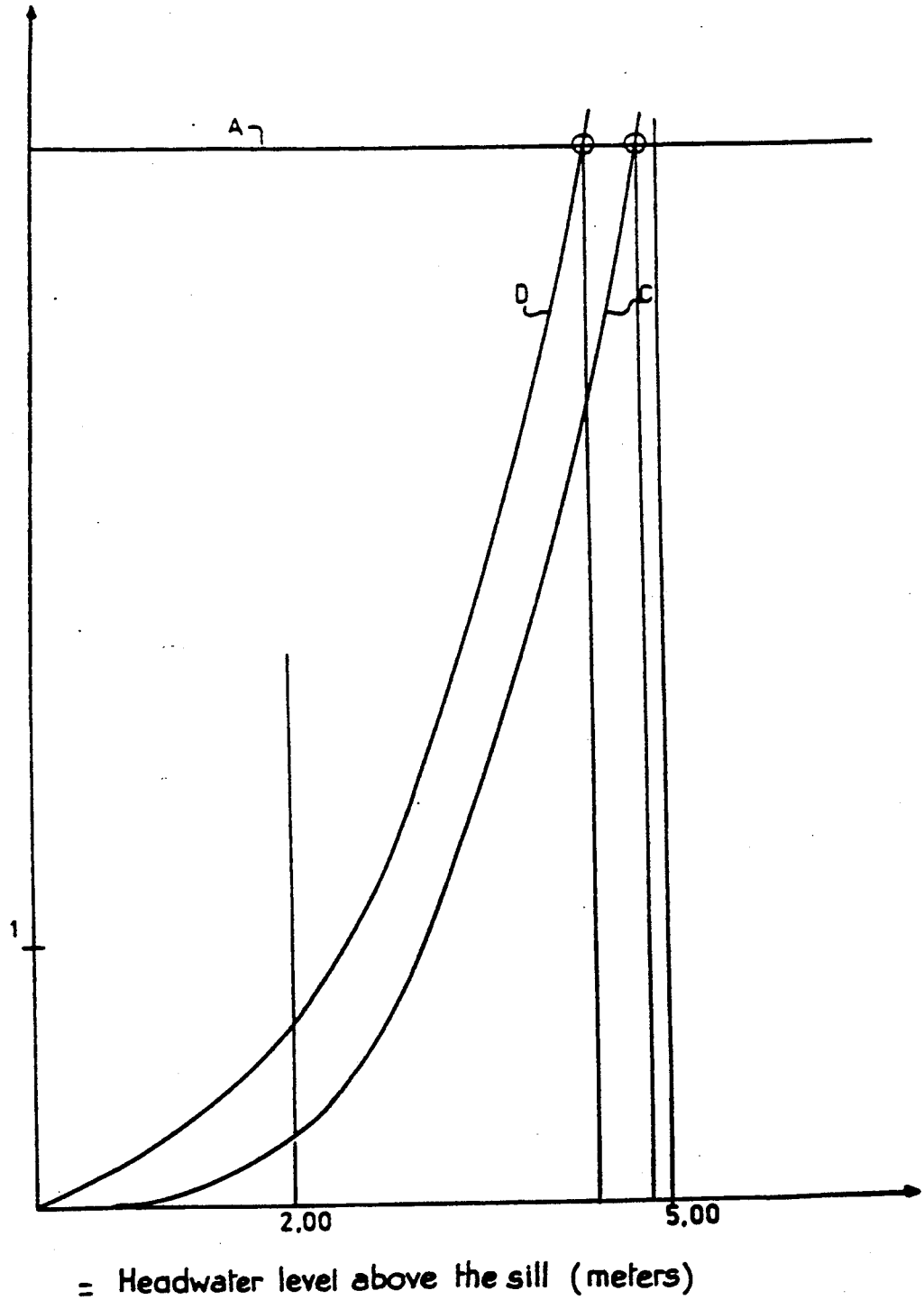
FIG. 6 is a chart showing the driving and resisting forces versus the head of water on the overspill sill.

On the graph in FIG. 6, curves A, C and D represent the values of Mr, Mm and MmU respectively as a function of the depth of water z above the sill 6. They are plotted from the equations described above for $H_1=5$ m, L=2.6 m, B=0.15 m, $\gamma w=10$ kNm$^{-3}$ and $\gamma b=24$ kNm$^{-3}$.

From curves A and C, it can be seen that the driving moment Mm (with no uplift U) reaches the same value as the resisting moment Mr when the value of z is approximately 4.8 m. In other words, in the absence of uplift pressure, the water level raising element 11 will overturn when the water level reaches a height of 4.8 m above the sill 6. From curves A and D, it can be seen that if uplift pressure is present, the driving moment MmU reaches the same value as the resisting moment Mr when the value of z is approximately 4.4 m. The water level raising elements in this example are thus suitable for a spillway designed for a 5 m head on the sill when the headwater level is RM. Eq.(11) and Eq.(13) show that, if it were desired that the water level raising element 11 should overturn for a value of z of 4.5 m without uplift pressure U and without changing the height $H_1$ of the said element, it would be necessary to adopt a different value of $\gamma b$ and/or of L and/or of B than those stated above From this, it can be seen that, by appropriately selecting the size and weight of the water level raising element 11 and the size of abutment 12, it can be so arranged that the element 11 will overturn at a predetermined headwater level. It can also be seen that if the element 11 had been designed to overturn at a predetermined water level in the absence of any uplift pressure acting on its underside and if the seal between the element 11 and the sill 6 is not fully efficient, an uplift pressure will act on the underside of the element 11 causing it to overturn at a lower water level than the aforementioned predetermined water level. Defective watertightness is thus not dangerous but is more of a safety factor in that it assists the overturning of the element.

This can be put to effective use to cause the element 11 to overturn even more reliably and more precisely with respect to the predetermined water level. It may be beneficial to arrange for there to be little or no uplift pressure U acting on the element 11 when the headwater level is below a predetermined level and then for a substantially higher uplift pressure to act suddenly on the element 11 precisely when the water level reaches the said predetermined level, with the elements designed so that at this precise instant the driving moment suddenly changes from a slightly lower value Mm than the value of the resisting moment Mr to a substantially higher value MmU than the value of the said resisting moment Mr. For this purpose, it is possible to provide a triggering device such as the example shown in FIG. 7. The triggering device shown in FIG. 7 consists essentially of a vent/pressurizing pipe or duct 21 which under normal conditions keeps the area underlying the water level raising element 11 at atmospheric pressure, the top or upper end 21*a* of the pipe 21 being at or slightly below a level N which is the water level at which it is desired for the element 11 to overturn (the difference between the level of the top end of the pipe and the level N being commensurate with the depth of water flowing over the lip of the pipe end as it fills). The pipe 21 may pass through the element 11 as shown by the solid lines of FIG. 7 or may be external to the said element 11 as shown by the chain dotted lines at 21' in FIG. 7 so that its top end rearwardly outside from the element 11. Alternatively, the vent/pressurizing pipe may be partly embeded into the sill 6 as also shown by the chain dotted at 21" in FIG. 7. If more than one water level raising element is provided, each designed to overturn at different water levels, at least one pipe is provided for each element 11, the top end of each pipe being set at the level for which the relevant element is to overturn. In this case of course the areas of the sill 6 underlying the water level raising elements designed to overturn at different water levels must be isolated from each other by an appropriate pattern of seals.

Figure 7:
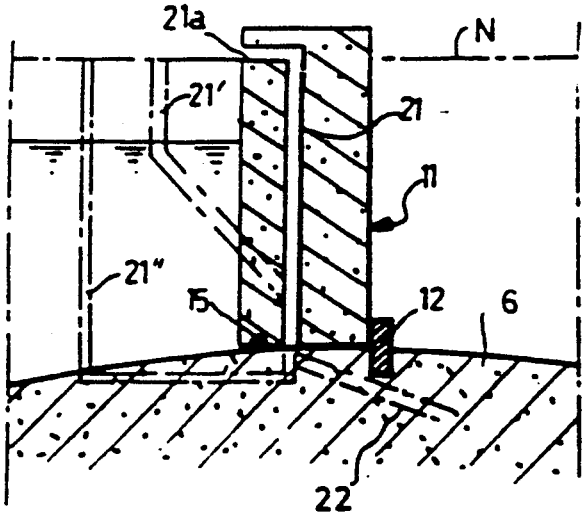
FIG. 7 is a vertical section showing a water level raising element of the invention incorporating a triggering device to overturn the element.
Figure 8:
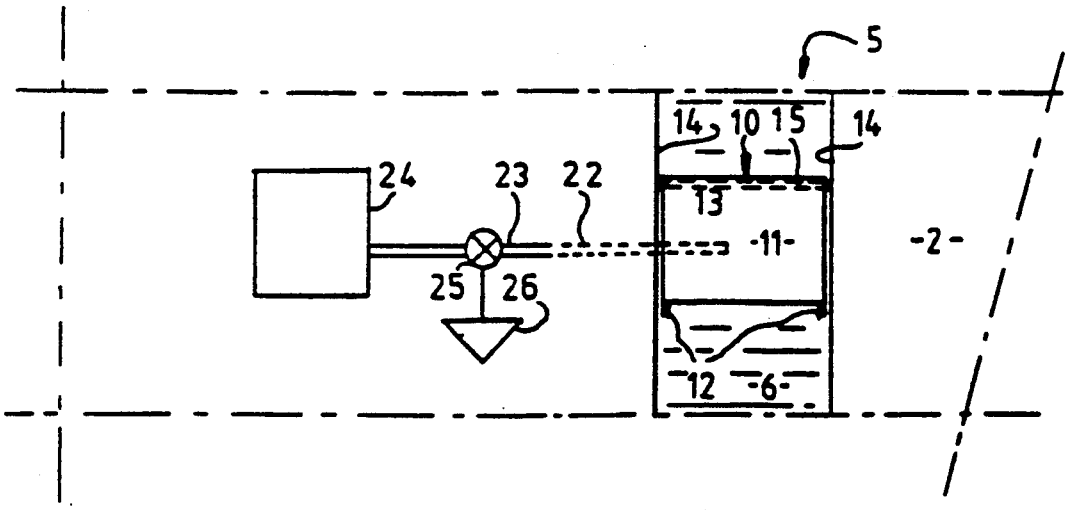
FIG. 8 is a plan view of an overspill sill provided with another triggering device.

A different type of triggering device as illustrated in FIG. 8 may also be provided in combination with or in place of the triggering device shown in FIG. 7. The device illustrated in FIG. 8 consists of a pipe 22 in an arrangement similar to what was described above in connection with pipe 21 and whose end, remote from the area under the base of the water level raising element 11, connects to a pressure supply device 24 controlled by a valve 25, itself actuated by an automatic control device 26 and/or manually operated mechanism to cause the water level raising elements to overturn at times when they would otherwise remain stable without such triggering device. The pressure supply device 24 may for example be a water tank set at a higher elevation than sill 6 and in which the free water surface is at atmospheric pressure. The pressure supply device 24 may alternatively be a pressure tank containing a pressurised fluid. The control mechanism 26 may consist for example of a handwheel acting directly on valve 25 or an automatic valve operating mechanism actuated by a device responsive to a sensor sensing the headwater level and/or inflow into the reservoir of the dam. It is clear that, depending on the pressure applied by device 24, overturning of at least one of the water level raising elements 11 can only occur when the headwater has reached a certain level. This arrangement assists in promoting selective early expulsion of the water level raising elements 11 in anticipation of the arrival of a very large flood for example.

One of the main advantages of this arrangement is that the reservoir can be partially drawn down on warning of the imminent arrival of an extraordinary flood by causing at least one of the water level raising elements 11 to overturn through a specific command and/or automatically in order to (i) reduce the number of water level raising elements having to be expelled when the full flood flow arrives at the spillway and (ii) reduce the outflow peak released into the downstream river reach.

It may beneficially improve safety at an existing dam whose overspill sill 6 had originally been set at a level appropriate for the originally-estimated design flood and determines the full supply level RN, to lower the sill 6 by a few decimetres below its original level (setting the original RN level) and to set on the lowered sill 6 a water level raising means 10 of the invention, consisting of at least one element 11 whose size and weight have been selected in the manner described hereinabove to overturn by rotation around abutment 12 when the headwater level reaches a predetermined level. Under these circumstances, the probability of breaching of the water level raising means 10 remains unchanged but in the event of the arrival of an extraordinary flood, the free discharge section available after complete expulsion of the water level raising means 10 is substantially increased with the same headwater level in the reservoir, enabling a much larger flood than the flood for which the dam was originally designed to be discharged without risk.

Figure 9A:
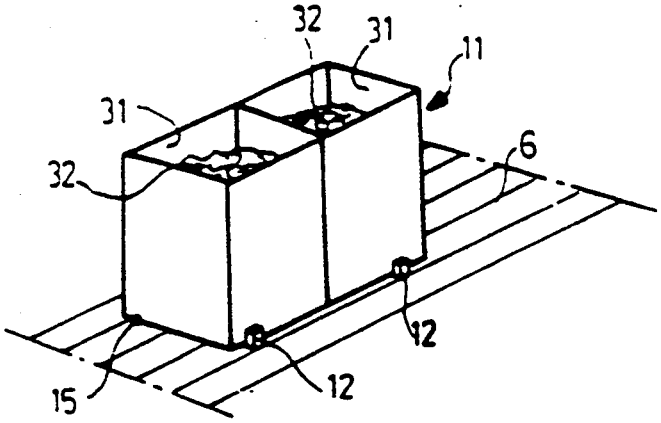
FIGS. 9*a* to 9*c* are perspective views of various possible embodiments of the water level raising elements of the invention.

In the foregoing description, it is assumed that each water level raising element 11 consists of a block of substantially parallelepiped shape. Each water level raising element 11 may consist of a hollow block as shown in FIG. 9*a* having one or more compartments containing a weighting or ballasting material 32 such as sand, gravel or other weighty bulk material. A cover (not illustrated) may be provided to close the compartment(s) 31 after filling with the weighting material. The type of construction shown in FIG. 9*a* is particularly suitable when the water level raising means 10 is to comprise several elements 11 all of the same height but overturning at different headwater levels. In this case, the weight of each element 11 can be controlled by filling with an appropriate quantity of weighting material 32 to ensure each element 11 overturns at the respective predetermined headwater level N. This form of construction also has the advantage of rendering easier the work of setting the water level raising elements 11 on the spillway crest, since they can be filled with weighting material after they are in their final position. It also promotes more efficient expulsion of the elements 11 since the force of the water would tend to wash away the weighting material after the element has overturned, thus reducing its weight.

Figure 9B:
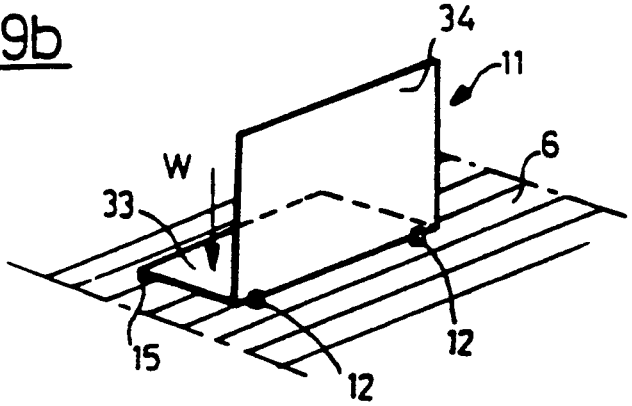

In another embodiment of the invention, each water level raising element 11 may consist of an assembly of plates made of concrete, steel or other appropriate stiff heavy material. As shown in FIG. 9*b*, the assembly may comprise a horizontal or substantially horizontal rectangular base plate 33 and a rectangular face plate 34 set vertically or making an angle $\alpha$ of up to 30 degrees to the vertical, rising from the trailing or downstream edge of the base plate 33. It can be seen that, in this case, the weight of water overlying the base plate 33 applies a resisting load and contributes to the stability of the element so long as the headwater level has not reached the predetermined level at which the said element overturns.

Figure 9C:
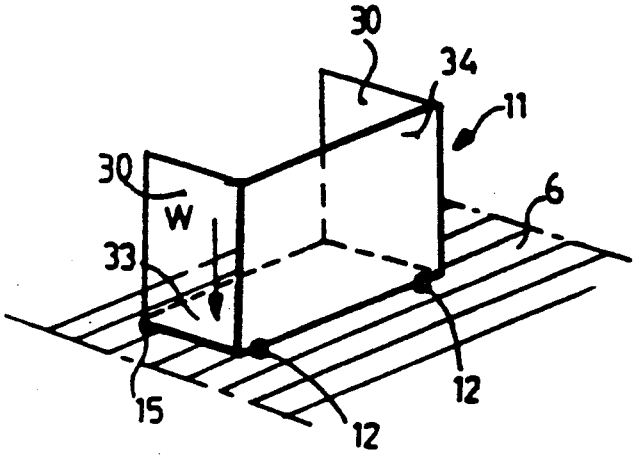

As shown in FIG. 9*c*, the assembly of plates may comprise, in addition to plates 33 and 34, a pair of side plates 30 joined to the base plate 33 along their lower edges and to the face plate 34 along their upright edges. In the specific embodiment shown in FIG. 9*c*, the side plates offer the advantage of reducing the sideways escape of water as seal 13 ruptures when the element 11 starts to overturn. This improves the efficiency and precision of the expulsion mechanism and prevents any oscillation of the water level raising element 11.

Figure 10:
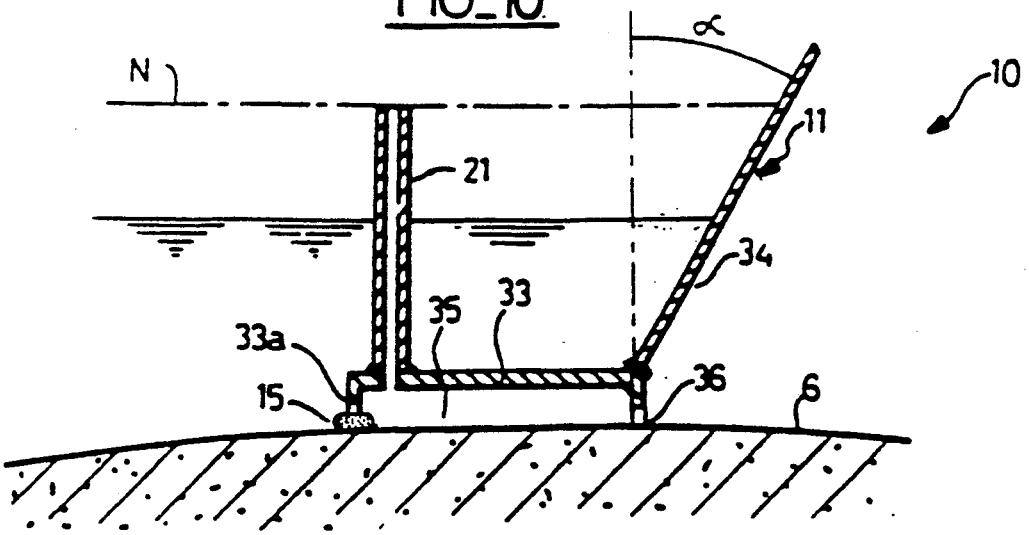
FIGS. 10 and 11 are vertical sections of two other possible variants of the water level raising elements of the invention.

FIG. 10 is a vertical cross section through a water level raising element 11 similar to those shown in FIGS. 9*b* and 9*c* with, in addition, a pipe 21 provided for the same purpose as in FIG. 7. In FIG. 10, the horizontal plate 33 is fixed to the face plate 34 in such a way as to place it some distance above the spillway sill 6 and on its upstream side it has a downturned lip 33*a*. The seal 15 is located between the lip 33*a* and the sill 6. This arrangement forms a chamber 35 under the plate 33 into which the lower end of the pipe 21 opens. An aperture 36 is provided at the bottom of the plate 34, this aperture 36 having a smaller flow area than the bore of the pipe 21.

With the water level raising element shown in FIG. 10, when the headwater level is close to but lower than level N, waves on the water surface might cause water to enter pipe 21. This ingress of water would partially fill chamber 35 which would simultaneously empty through hole 36. This prevents the build-up of uplift pressure under the plate 33 due to wave action so long as the headwater level has not reached the level N at which it is desired that the water level raising element should overturn. The chamber 35 and the hole 36 thus increase the accuracy and precision of the overturning setting. It is of course possible to provide a chamber similar to chamber 35 under the element shown in FIG. 7 together with a drain opening to this chamber similar to the aperture 36.

Figure 11:
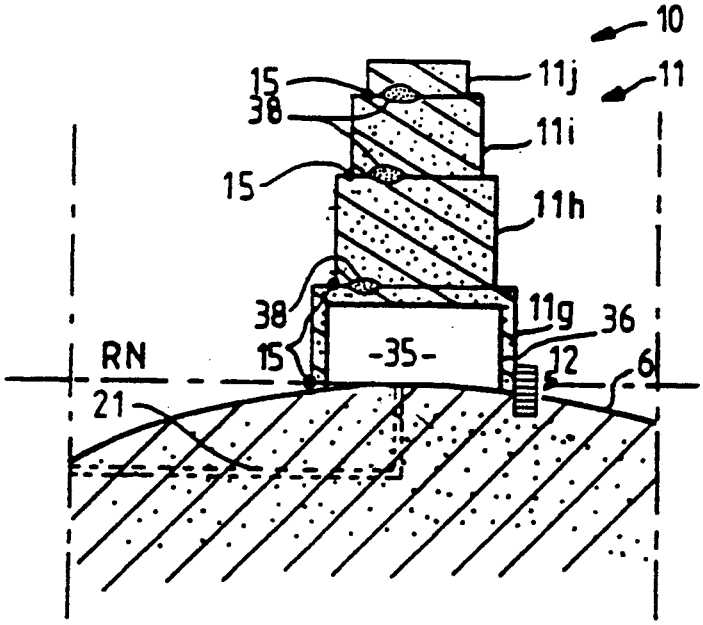

FIG. 11 is a vertical cross section through a water level raising element 11 made up of a stack of modules 11*g* to 11*j*. Contiguous modules are joined together by means of interface devices 38 preventing the upper modules from sliding towards downstream. The interface devices 38 may for example consist of hooks or an interlocking shape given to the modules. The modules may all have the same or different vertical dimensions. For example, the topmost module 11*j* has a smaller vertical dimension than the other modules shown. This type of water level raising element construction has the advantage of making installation easier. The interface devices 38 may beneficially be designed so that, as the modules overturn, they are freed from each other automatically or by the action of separate struts or cables which may for example be operated from a walkway (not illustrated) spanning the spillway. Both embodiments of the interface devices described above are appropriate for such arrangements.

In the embodiment shown in FIGS. 12 to 15, the parts of the water level raising element 11 which are identical or fulfill the same function(s) as those previously described are designated by the same reference numerals.

Figure 13:
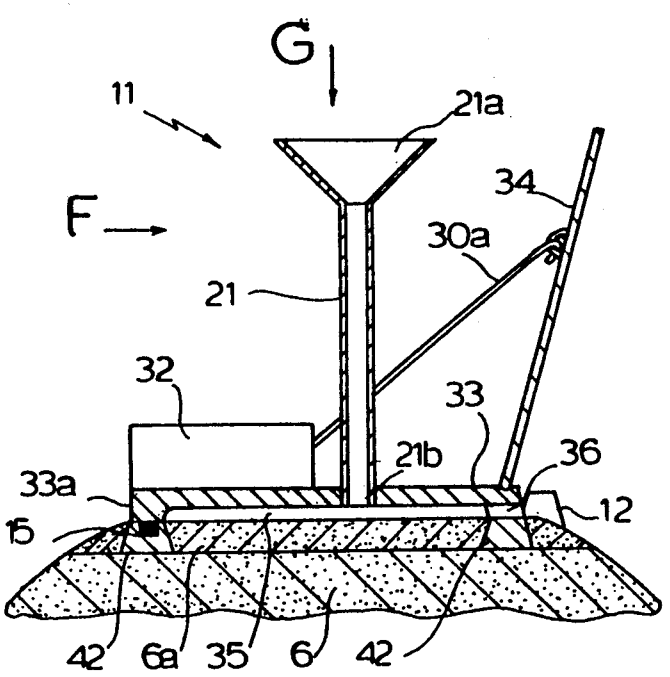
FIGS. 13 and 13*a* is a vertical cross section through one of the water level raising elements shown in FIG. 12.
Figure 13A:
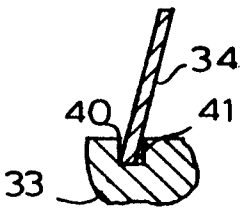
Figure 12:
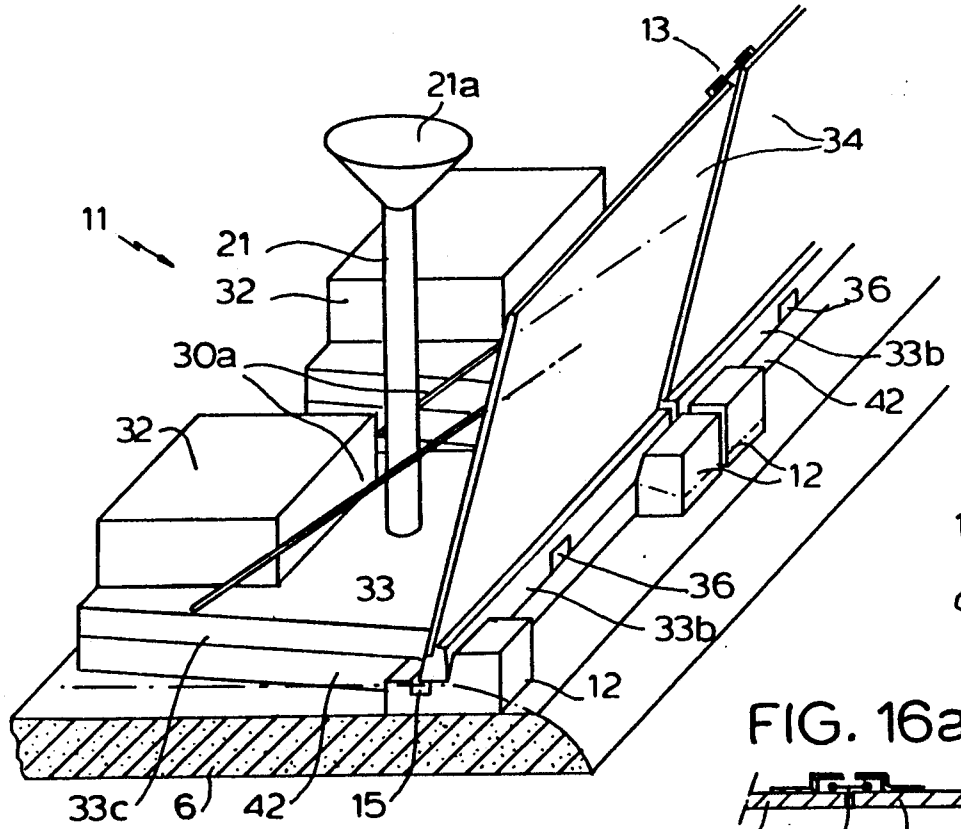
FIG. 12 is a perspective view showing two adjacent water level raising elements in another embodiment of the invention.

As illustrated in FIGS. 12 and 13, the assembly of plates may comprise a substantially rectangular or trapezoidal, horizontal or substantially horizontal base plate 33, and a rectangular or trapezoidal face plate 34 set vertically or making an angle $\alpha$ of not more than 30 degrees to the vertical. As is more readily discernible from FIG. 13*a*, the lower edge of the face plate 34 engages freely in a slot 40 in the base plate 33, preferably in the region of the downstream edge of the said base plate. A seal 41 is provided in the slot 40 between the plates 33 and 34. Of course, the face plate 34 may alternatively be rigidly fixed to the base plate 33.

In the embodiment illustrated in FIGS. 12 to 15, the assembly of plates includes at least one tie, for example the two ties 30*a* joined at their extremities to the base plate 33 and the face plate 34. The addition of two ties 30*a* is preferable when the water level raising elements 11 are very high since they contribute to the more efficient transmission of loads from the face plate 34 to the base plate 33. Ties may be made of steel or other appropriate material. One or more gusset plates of the kind illustrated as plates 30 in FIG. 9*c* may of course be substituted for the tie(s).

As shown in FIGS. 12 and 13, the base plate 33 is raised above the sill 6 and has a downturned lip 33*a* at its upstream edge, a downturned lip 33*b* at its downstream edge, and two downturned lips 33*c* along either lateral edge, these four lips mating with a prefabricated frame 42 laid on the sill 6, the said sill being appropriately cut back or suitably designed from the outset. A suitable thickness of mortar 6*a* is then poured on the sill 6 to encase the frame 42 so that its upper surface is flush with the final sill surface, ready to receive the water level raising element 11. Needless to say that the four lips 33*a*, 33*b* and 33*c* may directly mate or engage with the sill 6 if the latter has been suitably arranged or designed from the outset.

A seal 15 is provided between lips 33*a*, 33*c* and frame 42 or sill 6 as the case may be. This produces a chamber 35 under the base plate 33. A pipe 21 with its lower part 21*b* opening into chamber 35 assists in the overturning of the water level raising element 11 at exactly the predetermined water level N by admitting an uplift pressure into chamber 35 as described with reference to FIGS. 7 and 10.

An aperture 36 is provided at the bottom of the downstream lip 33*b* on base plate 33 to drain chamber 35 when water has entered therein through waves temporarily overtopping the upper end 21*a* of pipe 21 or leakage past seal 15.

Figure 14:
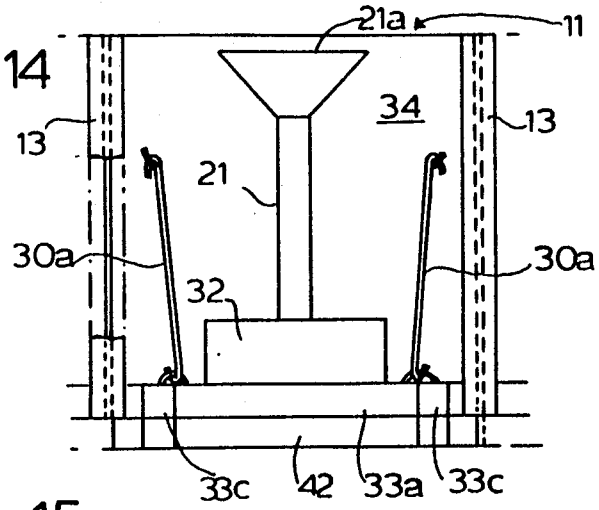
FIGS. 14 and 15 are views of the water level raising element shown in FIG. 13 along the direction shown by arrows F and G respectively.
Figure 15:
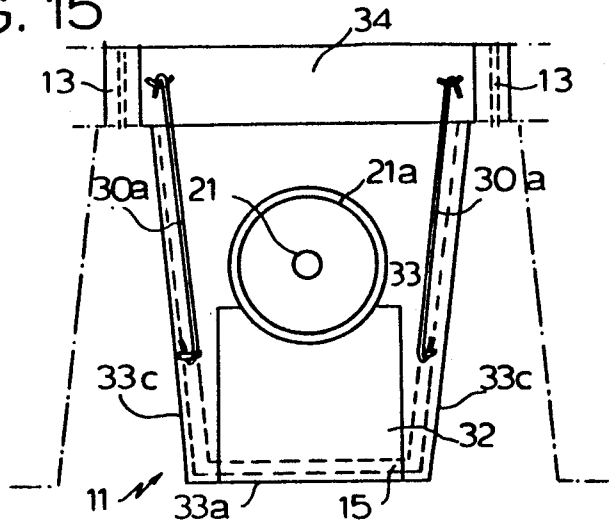

In the embodiment shown in FIGS. 12, 14 and 15, seals 13, made of rubber or other appropriate material, are provided at each of the lateral extremities of the water level raising elements 11. Seal 13 must be designed in such a way that, when the water level raising means 10 comprises a plurality of water level raising elements 11, the overturning of any one of the said elements 11 does not entrain the other elements 11.

Figure 16A:
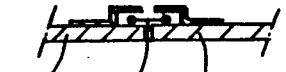
FIGS. 16*a* and 16*b* are cross sections at a larger scale of a detail of the water level raising element shown in FIG. 13.
Figure 16B:
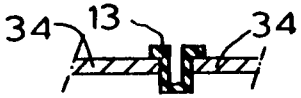

FIGS. 16*a* and 16*b* are cross sections through two possible forms of the seal 13 meeting the above design requirement.

The pipe 21 may rise vertically above the base plate 33 as illustrated in FIGS. 12 and 13 or obliquely towards upstream like the pipe 21′ in FIG. 7. The pipe 21 may again be partly buried in the sill 6 like the pipe 21″ in FIG. 7.

Figure 17:
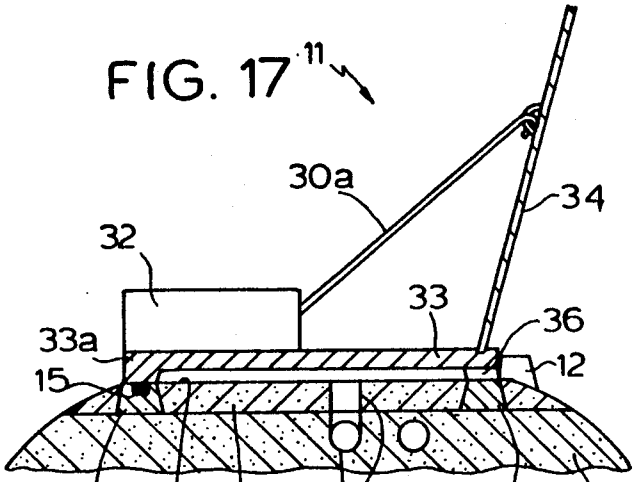
FIG. 17 is a view similar to that of FIG. 13 showing a variant of the water level raising element.
Figure 18:
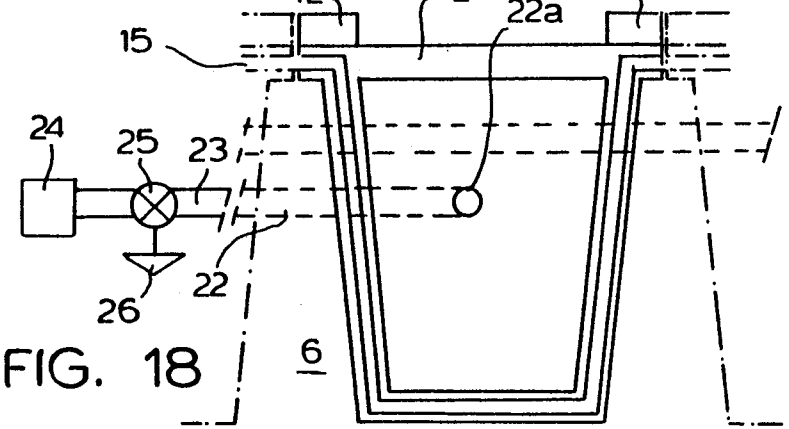
FIG. 18 is a plan view of part of a spillway sill before water level raising element as the one shown in FIG. 17 are placed on the prepared sill.

A different type of triggering device as illustrated in FIGS. 17 and 18 and similar to the one illustrated in FIG. 8 may also be provided in combination with or in place of the triggering device shown in FIGS. 12 to 15. The device illustrated in FIGS. 17 and 18 consists of a pipe 22 whose end 22*a* opens into the chamber 35 and whose remote end 23 connects to the pressure supply device 24. The pipe 22 may be fitted with a valve 25, itself acuated by an automatic control device 26 and/or manually operated mechanism, all as described hereinabove. The pressure supply device 24 may for example be a water tank set at a higher elevation than sill 6 and in which the free water surface is at atmospheric pressure, or the water impounded in the reservoir (which would be the simplest solution).

As shown in FIGS. 12, 13 and 17, each water level raising element 11 is preferably prevented from sliding downstreamwards by one or more abutments 12 bolted to or cemented into the sill 6 or integrally made with the frame 42. Also shown in FIGS. 12 and 17, among others, the water raising element 11 may be completed by an added weight 32 placed on plate 33 in the form of a single unit of weighty material, a stack of multiple weights or loose material in a suitably designed container. The weight 32 enables the balance between the driving moment and the resisting moment to be optimised while allowing the various parts of the water level raising element 11 to be of relatively lightweight construction for convenient handling.

Although the water level raising element 11 is heavy and rigid once assembled, the connections between the constituent parts of the said element may be designed and built in such a way that, after the element has overturned, each constituent part separates from the others, leaving only relatively small pieces to be recovered or left in place downstream of the dam. For example, in the embodiments illustrated in FIGS. 12 to 18, the ties 30*a* may be attached to plates 33 and 34 by means, for example, of hooks and eyes which separate when the water level raising element overturns. This type of design is especially attractive for water level raising elements of large unit size since it has the added advantage that only relatively lightweight constituent parts have to be carried to the crest of the spillway.

The water level raising means of the invention exhibits numerous beneficial and attractive features, viz:

1. The manufacture and installation of water level raising means to replace some of the control gates on a very large spillway would be more economical than the cost of the said gates and would not usually necessitate any major modifications to the structure.

2. The water level raising means of the invention provide quasi-permanent closure of all or part of the length of the spillway over a greater height than feasible with the water level raising means described in the two U.S. Pat. Nos. 5,032,038 and 5,061,118 hereinabove mentioned while still offering a totally reliable and safe means of discharging extraordinary floods, generally without human or other outside action.

3. The water level raising means of the invention is suitable for the installation of elements of limited width so that outflow into the downstream reach of the river is only slightly increased as each element overturns.

It is expressly understood that the embodiments of the invention described hereinabove are given on a purely illustrative basis and in no way preclude other alternative forms and that numerous modifications can readily be elaborated by any person ordinarily skilled in the art without departing from the basic principles of the invention.

What is claimed is:

1. Spillway for discharging extraordinary floods for dams and similar works having two flood discharge structures, one of the two discharge structures being an overspill sill whose crest is set at a first predetermined level lower than a second predetermined level corresponding to a maximum reservoir level for which the dam is designed, the difference between the said first and second predetermined levels corresponding to a predetermined maximum discharge of an extraordinary flood, and a moveable water level raising means closing off the said sill, wherein the water level raising means comprises at least one heavy rigid element resting on the crest of the overspill sill and held in place thereon by gravity, the said element having a predetermined height at least equal to the difference between the first and second predetermined levels and being of such size and weight that the moment of the forces applied by the headwater on the element comes to equal the moment of the gravity forces tending to maintain the element in place on the overspill sill so that consequently the element is destabilized when the water reaches a third predetermined level at most equal to the second predetermined level.

2. Spillway as claimed in claim 1, wherein an abutment of predetermined height is provided on the overspill sill at the downstream toe of the water level raising element to prevent the said element from sliding downstreamwards on the said sill.

3. Spillway as claimed in claim 1, wherein, in the case of an existing spillway, the crest of the overspill sill is lowered to a lower level than the said first predetermined level, and the water level raising element is installed on the lowered sill.

4. Spillway as claimed in claim 1, wherein a seal is provided between the overspill sill and the base portion of the water level raising element near the upstream edge of the said base portion.

5. Spillway as claimed in claim 1, wherein the said water level raising element has the material form of a substantially parallelepiped hollow block containing a weighting material.

6. Spillway as claimed in claim 1, wherein the said water level raising element consists of an assembly of plates which comprises a substantially horizontal base plate and a face plate rising from a base plate at an angle of 0 to 30 degrees with the vertical.

7. Spillway as claimed in claim 6, wherein the said water level raising element comprises side plates.

8. Spillway as claimed in claim 1, further comprising at least one duct means which under normal service conditions maintains the area underlying the water level raising element at atmospheric pressure, said duct means having an upper end which is at a level equal to or lower than the said third predetermined level and vertically above or upstream of the water level raising element.

9. Spillway as claimed in claim 1, further comprising duct means connecting the area underlying the water level raising element to a pressure supply device through a valve operated by control means.

10. Spillway as claimed in claim 1, wherein a plurality of water level raising elements are located side-by-side along the crest of the overspill sill with seals between adjacent side faces of the said elements.

11. Spillway as claimed in claim 1, wherein the size and weight of the water level raising elements are such that at least a first one of the said water level raising elements is destabilized when the headwater reaches the said third predetermined level, said third level being lower than said second predetermined level, that at least a second one of said water level raising elements is destabilized when the headwater reaches a fourth predetermined level between the second and third predetermined levels, and that at least a third one of said water level raising elements is destabilized when the headwater reaches a fifth predetermined level higher than the fourth level but not higher than the second predetermined level.

12. Spillway as claimed in claim 8 or 9, wherein a chamber is provided at the base of the water level raising element between the said element and the overspill sill, and an aperture is provided on the downstream side of the said element to drain the said chamber.

13. Spillway as claimed in claim 12, wherein the duct means opens into the said chamber.

14. Spillway as claimed in claim 1, wherein the water level raising element comprises a plurality of parts detachably assembled together so that the said parts can spontaneously separate from each other when the said element overturns.

15. Spillway as claimed in claim 14, wherein the water level raising element comprises a plurality of stacked modules, contiguous modules being joined together by means of an interface device preventing the upper module of a pair from sliding downstreamwards.

16. Spillway as claimed in claim 14, wherein the said water level raising element consists of an assembly of plates which comprises a substantially horizontal base plate and a face plate rising from a base plate at an angle of 0 to 30 degrees with the vertical, and wherein the base plate has a slot in its upper face, the lower edge of the face plate freely engages in the slot and at least one tie is detachably connected at each end to the base plate and the face plate.

17. Spillway as claimed in claim 1, wherein the other of the two discharge structures conventional spillway having a crest set at a fourth predetermined level lower than said third predetermined level.

* * * * *